US012766393B2

(12) United States Patent
Wang

(10) Patent No.: US 12,766,393 B2
(45) Date of Patent: Oct. 20, 2026

(54) SINGLE PUCK DRIBBLING PLATE AND MODULAR PUCK DRIBBLING PLATE

(71) Applicant: Potent Sports & Tech Co., Ltd, Nantong (CN)

(72) Inventor: Li Wang, Nantong (CN)

(73) Assignee: Potent Sports & Tech Co., Ltd, Nantong (CN)

( * ) Notice: Subject to any disclaimer, the term of this patent is extended or adjusted under 35 U.S.C. 154(b) by 247 days.

(21) Appl. No.: 18/636,303

(22) Filed: Apr. 16, 2024

(65) Prior Publication Data

US 2024/0261653 A1 Aug. 8, 2024

(30) Foreign Application Priority Data

Oct. 11, 2023 (CN) ..... 202311314435.9

(51) Int. Cl.
*A63B 69/00* (2006.01)
*A63B 71/06* (2006.01)

(52) U.S. Cl.
CPC ..... *A63B 69/0026* (2013.01); *A63B 71/0605* (2013.01); *A63B 71/0622* (2013.01); *A63B 2071/0694* (2013.01); *A63B 2210/50* (2013.01); *A63B 2225/74* (2020.08)

(58) Field of Classification Search
CPC ..... A63B 69/0026; A63B 71/0605; A63B 71/0622; A63B 2071/0694; A63B 2210/50; A63B 2225/74; A63B 71/06; A63B 2102/24; A63B 63/00; A63B 2220/833; A63B 2225/50; A63B 67/14; A63B 71/0619
See application file for complete search history.

(56) References Cited

U.S. PATENT DOCUMENTS

| | | | | |
|---|---|---|---|---|
| 3,709,489 | A * | 1/1973 | Holleran | A63B 69/00 273/DIG. 4 |
| 10,722,773 | B2 * | 7/2020 | Houlihan | A63B 67/14 |
| 12,290,730 | B2 * | 5/2025 | Near | A63B 71/0622 |
| 2007/0219024 | A1 * | 9/2007 | Allegre | A63B 69/002 473/422 |
| 2011/0230283 | A1 | 9/2011 | Hougen | |
| 2018/0099201 | A1 | 4/2018 | Marty et al. | |
| 2019/0392729 | A1 * | 12/2019 | Lee | G06V 20/42 |
| 2020/0184846 | A1 * | 6/2020 | Zhang | A61B 5/1116 |
| 2022/0118331 | A1 * | 4/2022 | de Lanauze | A63B 69/0026 |
| 2022/0161121 | A1 * | 5/2022 | Syed | A63B 69/3605 |
| 2024/0181323 | A1 * | 6/2024 | Meloy | A63B 71/03 |

* cited by examiner

*Primary Examiner* — Peter J Iannuzzi
(74) *Attorney, Agent, or Firm* — Hemisphere Law, PLLC

(57) ABSTRACT

The disclosure relates to the field of equipment for ice hockey training, and particularly discloses a single puck dribbling plate and a modular puck dribbling plate. A player can select the number and the combination mode of the single puck dribbling plates according to requirements, the training cost of the player is effectively reduced, and meanwhile different training requirements can be better met. The modular puck dribbling plate can be connected with terminal device, and data generated in the training process can be intelligently analyzed through the terminal device, so that the training effect of players can be better monitored. In addition, the modular puck dribbling plate has the advantages of being convenient to store and carry and the like.

8 Claims, 10 Drawing Sheets

SINGLE PUCK DRIBBLING PLATE AND MODULAR PUCK DRIBBLING PLATE

TECHNICAL FIELD

The present disclosure relates to the field of ice hockey training equipment, and in particular to a single puck dribbling plate and a modular puck dribbling plate

BACKGROUND

Ice hockey is a collective competitive sport with ice skates and ice hockey sticks as tools on ice. Players often need to go through a long time of training before the official game to improve their skills such as puck control, passing and shooting. In the current training processes, some directly conduct multi-person training in professional venues, which has large cost investment, large space occupation and high requirements for venues, and some use the existing ice hockey training equipment for training on the ice hockey training venues, which occupies a large space and has high requirements for venues.

SUMMARY

It is an objective of the present disclosure to provide a single puck dribbling plate and a modular puck dribbling plate, which combine the functions of the training venues and the training equipment, and can increase or decrease the number of the single puck dribbling plates and change the combination mode of the single puck dribbling plates according to training requirements.

The present disclosure provides a single puck dribbling plate, and the single puck dribbling plate is provided with a scoring area and/or a missing area, the scoring area and the missing area are both provided with an indicator and a sensor, a processor is arranged in the single puck dribbling plate, and the indicators and the sensors are both connected with the processor.

In some embodiments, the single puck dribbling plate is connected with a built-in or external power supply, the processor includes a master control module, a communication module, an indicator control module, a sensor control module, and a storage module, the communication module, the indicator control module, the sensor control module, and the storage module are all connected with the master control module, the master control module is configured to coordinate the work of each module connected thereto;

the communication module is configured to connect other single puck dribbling plates and/or a terminal device;

the indicator control module is configured to control the work of an indicator;

the sensor control module is configured to control the work of a sensor; and the storage module is configured to store preset information, and the preset information includes identification information, and specification information of the single puck dribbling plate.

In some embodiments, the processor further includes an identification module and a positioning module, the identification module is configured to identify identification information of other single puck dribbling plates connected with the single puck dribbling plate, the positioning module is configured to acquire a position where a single puck dribbling plate is located;

a cross-section of the single puck dribbling plate is rectangular or triangular; and the indicator is a light which is able to be combined into a variety of colors through RGB.

In some embodiments, a main body of the single puck dribbling plate is made of PE or HDPE material;

the single puck dribbling plate is a first single puck dribbling plate having a rectangular cross-section or a second single puck dribbling plate having a triangular cross-section, the first single puck dribbling plate being adapted to the second single puck dribbling plate; the first single puck dribbling plate is provided with one or more circular first scoring areas, and the first single puck dribbling plate is further provided with one or more elongated first missing areas; the second single puck dribbling plate is provided with an elongated second missing area.

A modular puck dribbling plate includes one or more single puck dribbling plates.

In some embodiments, the combination mode of the single puck dribbling plates of the modular puck dribbling plate includes:

a first combination mode, a single puck dribbling plate having a rectangular cross-section, a second combination mode, a plurality of single puck dribbling plates having rectangular cross-sections, a third combination mode, a single puck dribbling plate having a rectangular cross-section and one or more single puck dribbling plates having triangular cross-sections, and a fourth combination mode, a plurality of single puck dribbling plates having rectangular cross-sections and one or more single puck dribbling plates having triangular cross-sections; and the adjacent single puck dribbling plates are able to be disassembled.

In some embodiments, the modular puck dribbling plate is connected with a terminal device to form an ice hockey training system, and the connection mode of the terminal device and the modular puck dribbling plate includes:

a first mode in which the terminal device is in communication connection with one single puck dribbling plate of the modular puck dribbling plate, the single puck dribbling plate being a main plate, and other single puck dribbling plates of the modular puck dribbling plate are in communication connection with the main plate; and a second mode in which the terminal device is directly in communication connection with all the single puck dribbling plates of the modular puck dribbling plate.

In some embodiments, the terminal device is an intelligent terminal having a display screen, the intelligent terminal is able to acquire the position and specification information of each single puck dribbling plate in the modular puck dribbling plate, and build a 3D virtual model corresponding to the modular puck dribbling plate according to the position information, each module in the 3D virtual model is in one-to-one correspondence with the single puck dribbling plate in the modular puck dribbling plate and is associated with each other, and a control interface of the corresponding single puck dribbling plate is entered by clicking the module after mutual association.

In some embodiments, the operation process of the ice hockey training system includes the following steps:

S1, controlling the indicator on one or more single puck dribbling plates in the modular puck dribbling plate to send an indication signal, and at the same time triggering the corresponding sensor to start working;

S2, performing an operation of dribbling the puck according to the indication signal;

S3, sensing the position information of the puck by the sensor, and transmitting the position information to the terminal device to determine whether the puck hits or touches an obstacle, and entering S5 if the puck hits, otherwise entering S4;

S4, accumulating the number of times of touching the obstacle, and transmitting the accumulated number of times of touching the obstacle to the terminal device for storage, and continuing to dribble the puck by a player to re-perform the operation of S3;

S5, calculating the time difference between the corresponding indicator sending the indication signal and the sensor sensing the puck hit and the current score, and saving the data;

S6, repeating operations of S1 to S5 until training is completed, acquiring all data stored in this training to form a data set; and S7, performing cluster analysis by a neural network algorithm, acquiring classification of the data set by optimizing an objective function via an iterative algorithm.

In some embodiments, the age information of the player is input before executing S1;

the operation process of the ice hockey training system further includes an aging operation, and the aging operation is performing aging judgment on the hit information in S5, presetting a threshold range corresponding to a time difference between the indicator sending the indication signal and the determination of the hit, comparing the calculated time difference with the threshold range, judging the hit to be a valid hit if the time difference is within the threshold range, then obtaining the current score, and saving the data, otherwise judging the hit to be an invalid hit with a score of 0;

or presetting a single training duration, the single training duration being a duration during which the indicator sends an indication signal and/or a duration during which the sensor is turned on, entering the step S5 if the hit is determined before the end of the single training duration, and accumulating the number of training times in the present inning; at the end of a single training duration, directly accumulating the number of training times in the present inning if the hit is missed, and at the same time sending an instruction to turn off the indicator and sensor corresponding to the current scoring area and/or missing area, and at the same time turning on the indicator and sensor corresponding to the next scoring area and/or missing area, and starting to recalculate the time difference between the indicator sending the indication signal and the determination of the hit; and the number of valid hits and the number of invalid hits are accumulated separately.

Advantages of the single puck dribbling plate and the modular puck dribbling plate according to the present disclosure are:

the modular puck dribbling plate is of modular design, the number and combination mode of the single puck dribbling plates can be selected by the player according to the needs to meet the training needs of different shapes and ranges, thus effectively reducing the training cost of players and better adapting to the needs of different training venues, different training difficulties and training objectives. In addition, the modular puck dribbling plate is also convenient for storage and carrying.

DETAILED DESCRIPTION

Example 1

Figure 1:
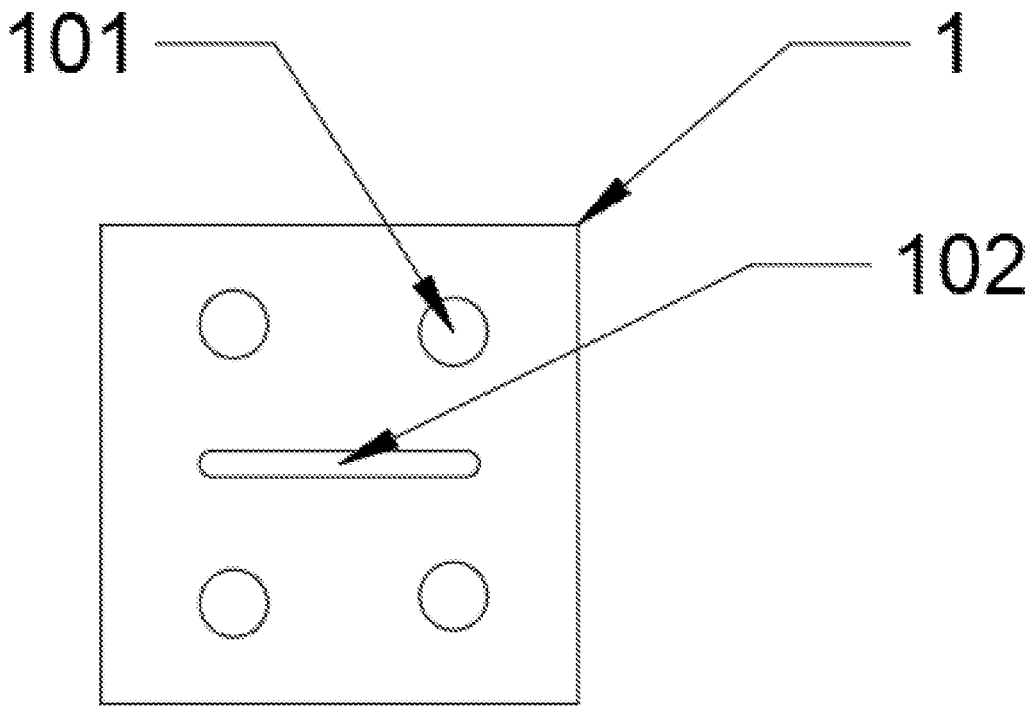
FIG. 1 is a schematic structural diagram of a modular puck dribbling plate formed in a first combination mode in some embodiments of the present disclosure.

With reference to FIGS. 1 to 10, the present embodiment discloses a single puck dribbling plate, the single puck dribbling plate is provided with a scoring area and/or a missing area, the scoring area and the missing area are both provided with an indicator and a sensor, the indicator is provided in correspondence with the sensor, a processor is arranged in the single puck dribbling plate, and the indicators and the sensors are both connected with the processor. The single puck dribbling plate is connected with a built-in or external power supply.

The processor includes a master control module, a communication module, an indicator control module, a sensor control module, and a storage module, the communication module, the indicator control module, the sensor control module, and the storage module are all connected with the master control module, the master control module is configured to coordinate the work of each module connected thereto;

the communication module is configured to connect other single puck dribbling plates and/or a terminal device;

the indicator control module is configured to control the work of an indicator;

the sensor control module is configured to control the work of a sensor; and the storage module is configured to store preset information, and the preset information includes identification information, and specification information of the single puck dribbling plate. The specification information of the single puck dribbling plate includes a shape, a length, a width, and a height, area information of the scoring area (e.g., coordinates of a center of the scoring area and a radius of the scoring area when the scoring area is circular), and area information of the missing area (e.g., coordinates of four corners of the missing area when the missing area is rectangular).

The processor further includes an identification module and a positioning module, the identification module is configured to identify identification information of other single puck dribbling plates connected with the single puck dribbling plate, the positioning module is configured to acquire a position where a single puck dribbling plate is located;

a cross-section of the single puck dribbling plate is rectangular or triangular; and the indicator is a light which is able to be combined into a variety of colors through RGB.

The sensor may be a Hall sensor or the like that can detect the position of the puck.

A main body of the single puck dribbling plate is made of PE or HDPE material.

In connection with what is shown in FIGS. 1 to 9, the single puck dribbling plate is a first single puck dribbling plate 1 having a rectangular cross-section or a second single puck dribbling plate 2 having a triangular cross-section, the first single puck dribbling plate 1 is adapted to the second single puck dribbling plate 2; one or more circular first scoring areas 101 are provided on the first single puck dribbling plate 1, and one or more elongated first missing areas 102 are further provided on the first single puck dribbling plate 1; the second single puck dribbling plate 2 is provided with an elongated second missing area 201.

Example 2

With reference to FIGS. 1-10, the present embodiment discloses a modular puck dribbling plate including one or more of the above-described single puck dribbling plates.

The modular puck dribbling plate includes a plurality of single puck dribbling plates, which are connected with each other, and the adjacent single puck dribbling plates are detachable, so that trainers can adjust according to needs to meet the needs of different training venues, different difficulties and training objectives. The connection modes between the single puck dribbling plates can be one or more of clamping, buckling, connecting with existing connectors such as bolts, etc. The connection modes can be realized by adopting the prior art, so they are not described here. The modular puck dribbling plate also has the advantages of convenient carrying and splicing installation.

Figure 2:
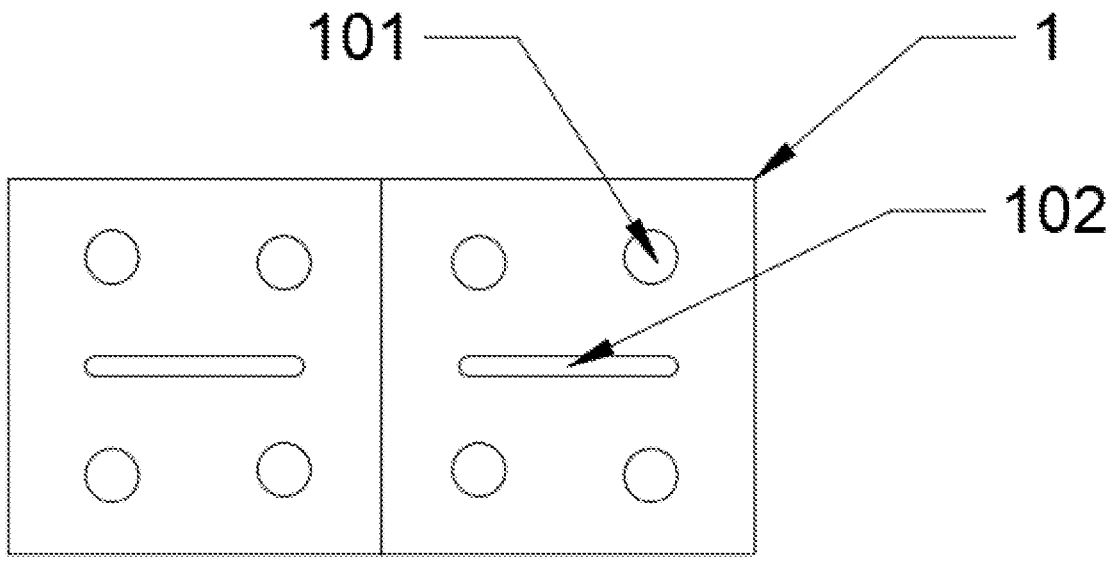
FIG. 2 is a schematic structural diagram of a modular puck dribbling plate formed in a second combination mode in some embodiments of the present disclosure.
Figure 3:
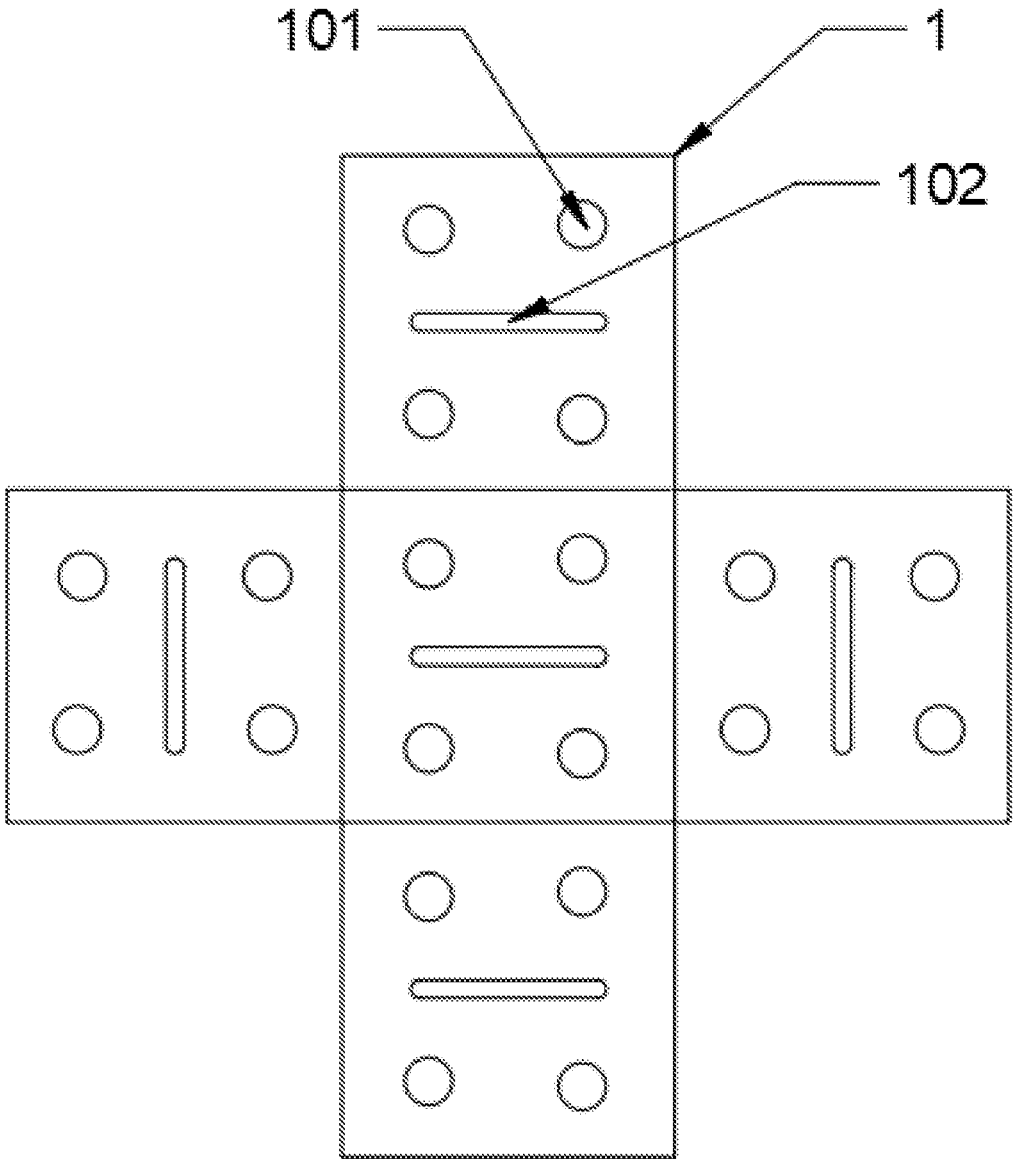
FIG. 3 is a schematic structural diagram of a modular puck dribbling plate formed in a third combination mode in some embodiments of the present disclosure.
Figure 4:
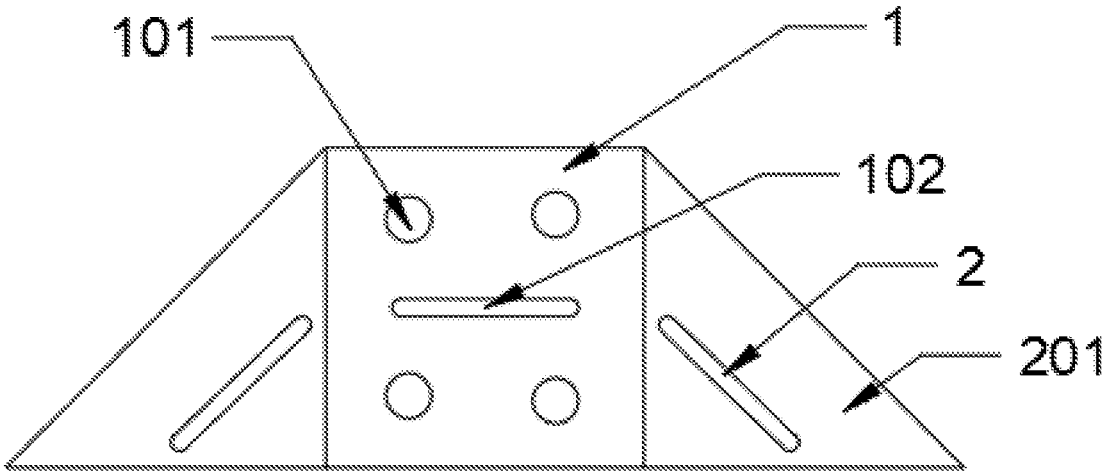
FIG. 4 is a schematic structural diagram of a modular puck dribbling plate formed in a fourth combination mode in some embodiments of the present disclosure.
Figure 5:
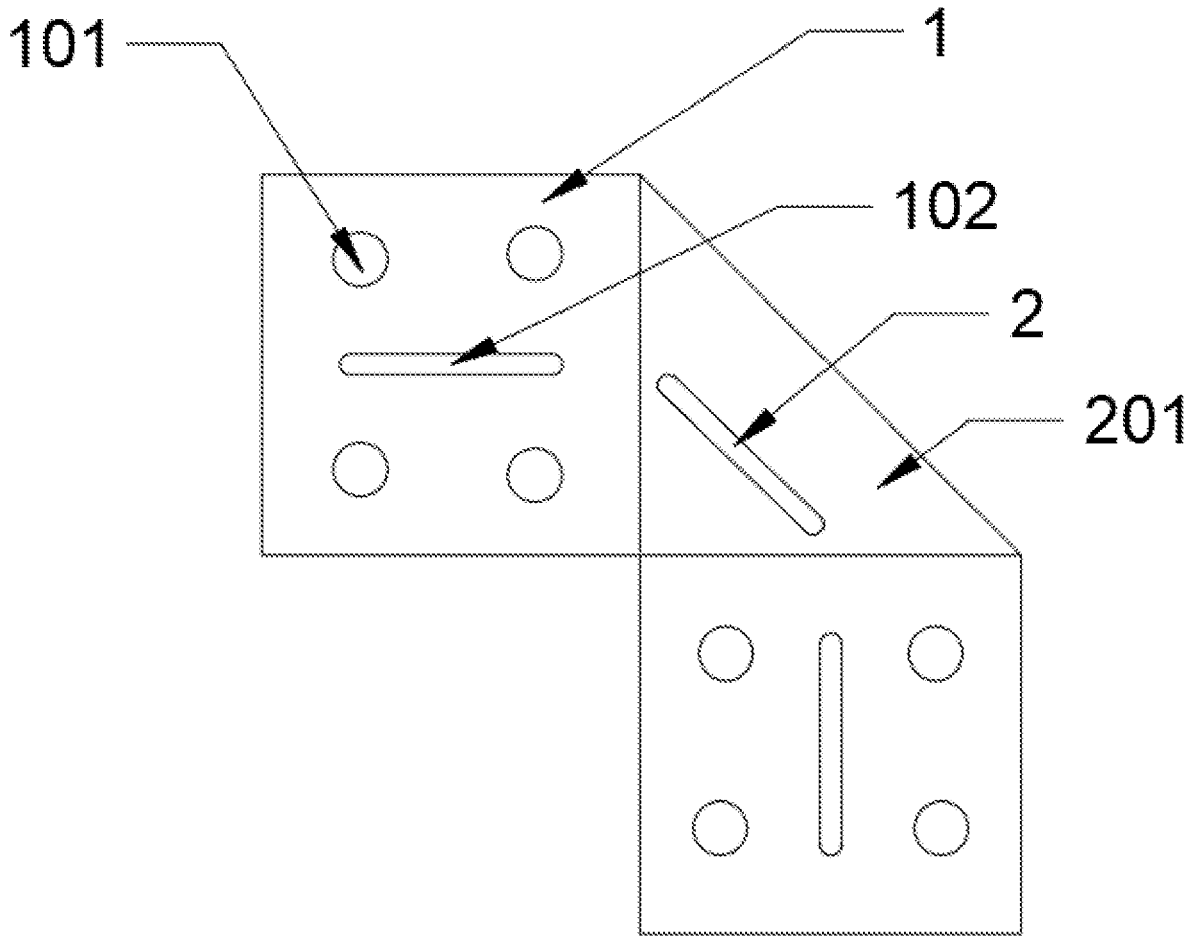
FIG. 5 is a schematic structural diagram of a modular puck dribbling plate formed in a fifth combination mode in some embodiments of the present disclosure.
Figure 6:
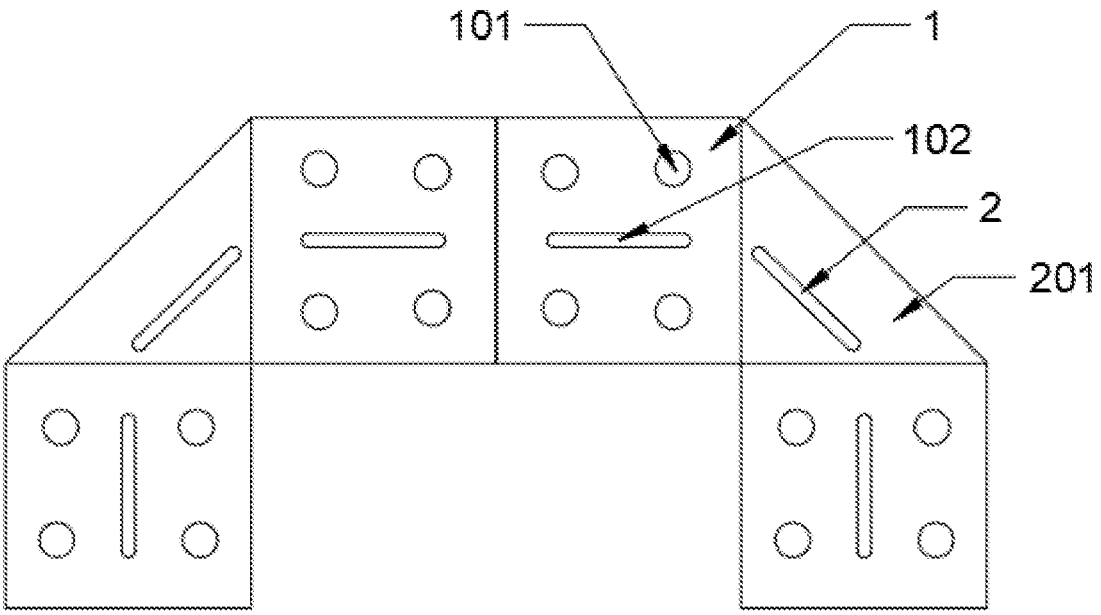
FIG. 6 is a schematic structural diagram of a modular puck dribbling plate formed in a sixth combination mode in some embodiments of the present disclosure.
Figure 7:
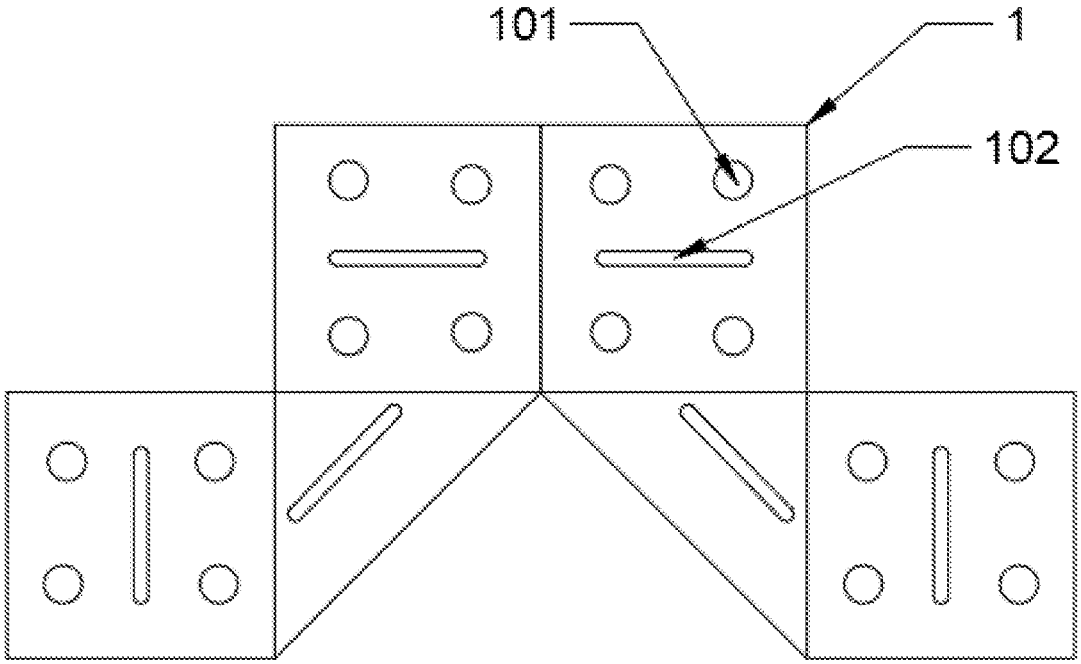
FIG. 7 is a schematic structural diagram of a modular puck dribbling plate formed in a seventh combination mode in some embodiments of the present disclosure.
Figure 8:
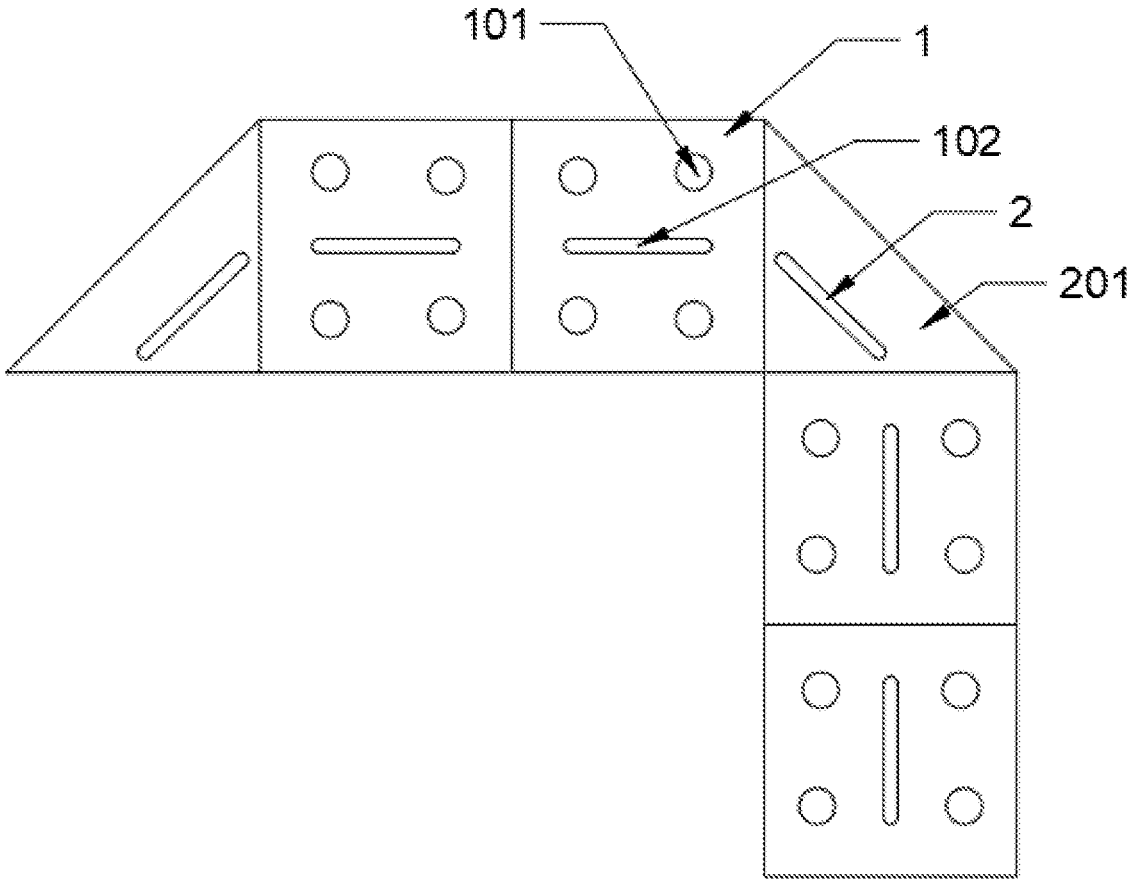
FIG. 8 is a schematic structural diagram of a modular puck dribbling plate formed in an eighth combination mode in some embodiments of the present disclosure.
Figure 9:
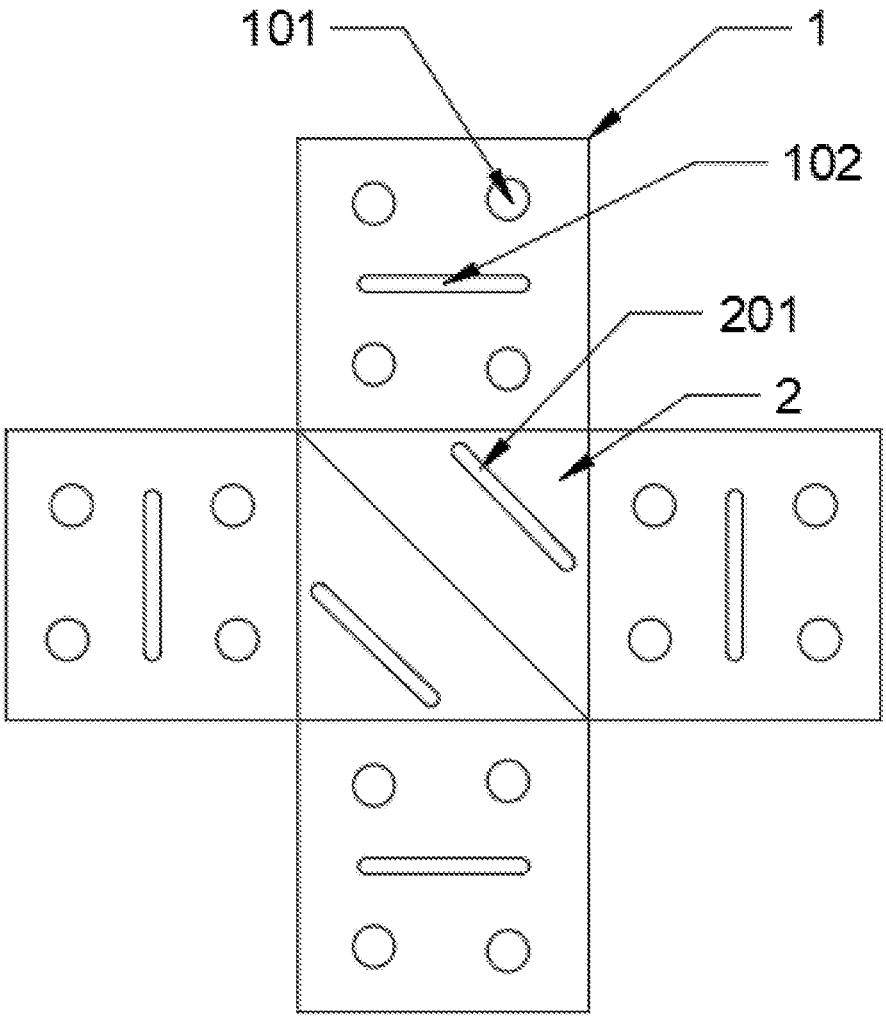
FIG. 9 is a schematic structural diagram of a modular puck dribbling plate formed in a ninth combination mode in some embodiments of the present disclosure.
Figure 10:
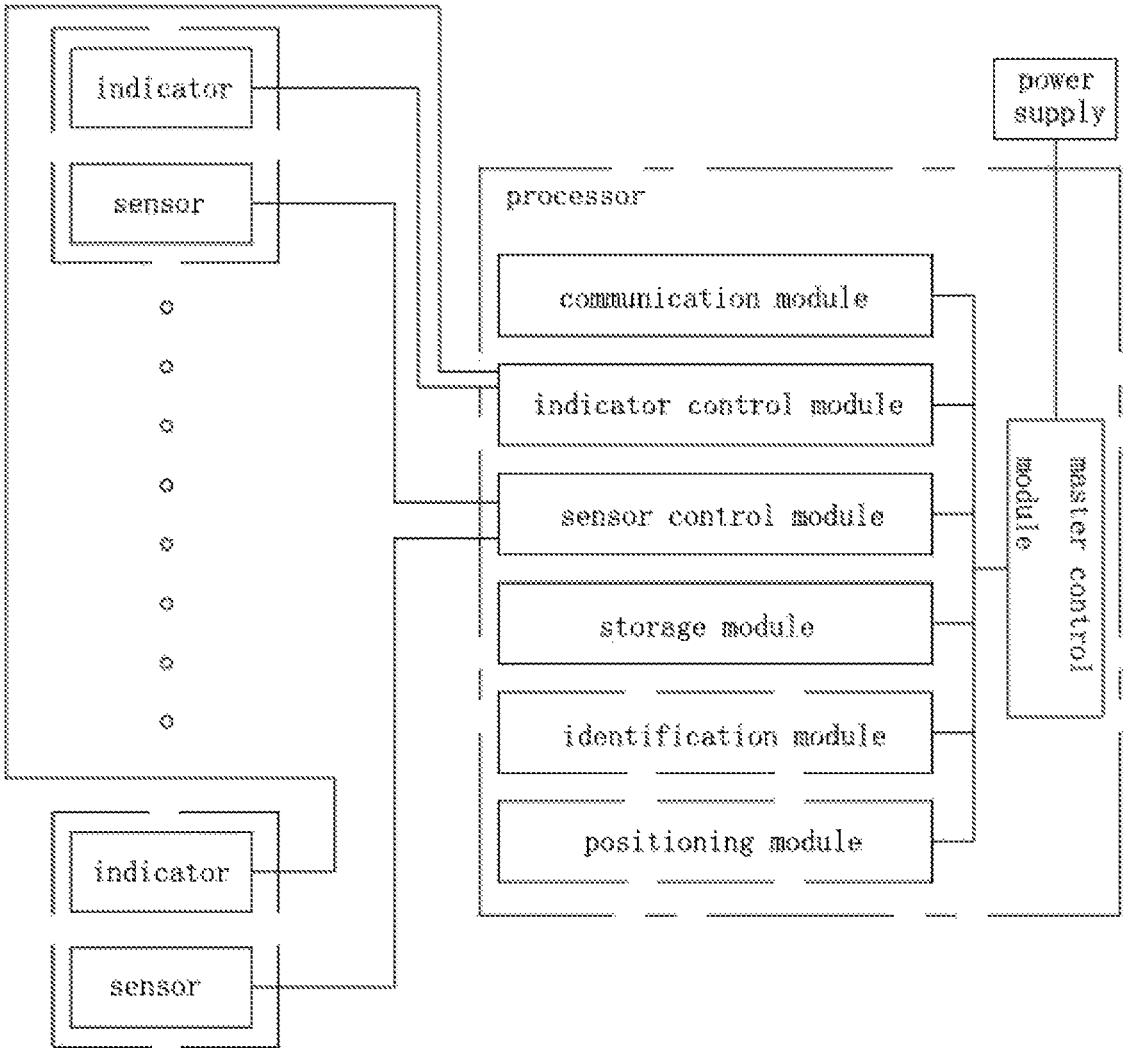
FIG. 10 is a schematic diagram of a frame structure of a single puck dribbling plate in some embodiments of the present disclosure.

The combination mode of the single puck dribbling plates of the modular puck dribbling plate includes:

a first combination mode, a single puck dribbling plate having a rectangular cross-section, as a structural schematic diagram shown in FIG. 1;

a second combination mode, a plurality of single puck dribbling plates having rectangular cross-sections, as structural schematic diagrams shown in FIGS. 2 and 3;

a third combination mode, a single puck dribbling plate having a rectangular cross-section and one or more single puck dribbling plates having triangular cross-sections, as a structural schematic diagram shown in FIG. 4, and a fourth combination mode, a plurality of single puck dribbling plates having rectangular cross-sections and one or more single puck dribbling plates having triangular cross-sections, as structural schematic diagrams shown in FIGS. 5, 6, 7, 8 and 9.

The modular puck dribbling plate can be used alone or connected with other equipment to form an ice hockey training system using the single puck dribbling plates.

When the modular puck dribbling plate is used alone, the single puck dribbling plates in the modular puck dribbling plate are in communication connection, and a control program of an indicator, a sensor, etc. in the single puck dribbling plate is placed in one or more single puck dribbling plates in advance, and the modular puck dribbling plate is controlled to work through the control program.

Example 3

Disclosed in this example is an ice hockey training system using a single puck dribbling plate, the ice hockey training system includes a terminal device and a modular puck dribbling plate as described in Example 2, and the modular puck dribbling plate is in communication connection with the terminal device, wherein a smart terminal having a display screen such as a mobile phone, a notebook computer or the like is selected.

The communication connection mode of the terminal device and the modular puck dribbling plate includes:

a first mode in which one single puck dribbling plate is a main plate, the main plate is connected with the terminal device and other single puck dribbling plates of the modular puck dribbling plate via the communication module, and the information interaction between the single puck dribbling plate except the main plate and the terminal device is carried out through the communication module on the main plate; and a second mode in which all the single puck dribbling plates in the modular puck dribbling plate are directly connected with the terminal device, and the single puck dribbling plates directly interact with the terminal device through their own communication modules.

The modular puck dribbling plate is connected with the terminal device after assembly.

The position of the single puck dribbling plate in the modular puck dribbling plate can be determined by a positioning module in the single puck dribbling plate.

A corresponding application is installed on the terminal device to integrate an intelligent analysis system onto the terminal device.

After the modular puck dribbling plate is assembled, it is connected with the terminal device. The terminal device obtains the position and specification information of each single puck dribbling plate in the modular puck dribbling plate, and can establish a 3D virtual model corresponding to the modular puck dribbling plate according to the position information. Each module in the 3D virtual model is in one-to-one correspondence with the single puck dribbling plate in the modular puck dribbling plate and is associated with each other, and a control interface of the corresponding single puck dribbling plate is entered by clicking the module after mutual association. Through the control interface, we can control whether the single puck dribbling plate works or not, and the working states of sensors and indicators on the single puck dribbling plate.

The indicators on the modular puck dribbling plate may send an indication signal at random or on the basis of an incoming instruction, and the corresponding sensor is turned on at the same time as the indication signal is sent.

The position information of the puck is obtained by the sensor during the dribbling of the puck, and the model of the puck is formed on the 3D virtual model according to the position information in the terminal device, and the dribbling position of the puck can be viewed directly from the display screen of the terminal device by coaches, trainers and the like.

The 3D virtual model, the puck model and the like corresponding to the modular puck dribbling plate constructed on the terminal device can be directly implemented by the prior art, and thus will not be described in detail herein.

When the ice hockey training system is first used, player information is stored in the terminal device, including ID, name, age and gender, which is convenient for retrieving the relevant information stored earlier for viewing when it is used later. ID is unique.

The ice hockey training system can also store the player's historical training information, which includes the player's age, the number of previous training innings, the hit rate in each inning, the hit time interval, the hit point, the score, the cumulative training time, the number of times of touching obstacles and other information.

The operation process of the ice hockey training system includes the following steps:

S1, the age information of the player is acquired, the information can be directly input through the terminal device, or can be retrieved from the player information stored in the terminal device according to the input ID and/or name of the player, the input means can be directly input from the terminal device, or the identification device installed on the terminal device can identify the chip storing the ID and/or name of the player so as to acquire the ID and/or name of the player, the chip can also store the historical training information of the player;

S2, the modular puck dribbling plate is started, the indicator on one or more single puck dribbling plates in the modular puck dribbling plate is controlled to send an indication signal, and the corresponding sensor is triggered to start working at the same time. The indicators that send the indication signals at least include an indicator of a scoring area and an indicator of a missing area, and the indicator of the scoring area sends the indication signal to indicate that the puck is dribbled to the area to score and the puck hits; the indicator of the missing area sends an indication signal to indicate that the area is an obstacle area, and the puck is dribbled to the area to indicate that the puck touches the obstacle; the mode in which the indicator sends the indication signal can be preset, for example, the following modes are set:

a simple mode in which, according to a specified rule, an indicator of a scoring area and an indicator of a missing area on a single puck dribbling plate are lit up, the specified rule is that when the indicators of different scoring areas on the same single puck dribbling plate receive a hit signal, the indicator corresponding to the current scoring area is turned off, and at the same time, according to one of clockwise and anticlockwise modes, the indicators corresponding to the next scoring areas are turned on one by one to send out indication signals, and circulation is performed in this way;

a first-level difficulty mode, the indicator of the missing area on the single puck dribbling plate continuously sends an indication signal, when the indicators of the scoring areas on the single puck dribbling plate receive the hit signal, the indicator corresponding to the current scoring area is turned off, and at the same time the indicator corresponding to the next scoring area is randomly started to send an indication signal;

a second-level difficulty mode, when the indicators of the scoring areas (the indicators of the scoring areas on different single puck dribbling plates) and the indicators of the missing areas (the indicators of the missing areas on different single puck dribbling plates) in the modular puck dribbling plate receive the hit signal, the indicators corresponding to the scoring areas and/or the missing areas which need to be turned off at present are turned off according to a preset sequence, and at the same time the indicators corresponding to the next scoring area and/or the missing area are turned on according to the preset sequence so as to send the indication signal; and a third-level difficulty mode, when the indicators of the scoring areas (the indicators of the scoring areas on different single puck dribbling plates) and the indicators of the missing areas (the indicators of the missing areas on different single puck dribbling plates) in the modular puck dribbling plate receive the hit signal, the indicators corresponding to the scoring areas and/or the missing areas which are turned on at present are randomly turned off, and at the same time the indicators corresponding to the next scoring area and/or the missing area are turned on randomly so as to send the indication signal.

The mode for sending the indication signal by the indicator described above can be individually determined according to the requirements of training, and the ranges of the scoring area and missing areas can also be preset according to specific training requirements.

S3, a sensor senses the position where the player dribbles the puck, and the position information of the puck sensed by the sensor is transmitted to the terminal device in real time, the puck positions are compared in the terminal device according to the preset ranges of the scoring area and missing areas, whether the puck hits or touches an obstacle is determined, and S5 is entered if the puck hits, and S4 is entered if the puck touches an obstacle;

the application corresponding to the operation of determining whether the puck hits or touches the obstacle can also be directly moved to the processor, and the operation of whether the puck hits or touches the obstacle can be determined by the processor connected with the sensor currently sensing the position where the player dribbles the puck;

S4, when the puck touches the obstacle, the indicator corresponding to the missing area where the puck is located sends the indication signal of touching the obstacle (the indicator transforms and emits light of different colors. For the same obstacle, the light emitted by one touch is light yellow, the light emitted by the second touch is yellow, the light emitted by the third touch is orange, and the light emitted by the fourth touch is red), the number of times of touching the obstacle is accumulated, and the accumulated number of times of touching the obstacle is transmitted to the terminal device for storage, and the player continues to dribble the puck to re-perform the operation of S3;

S5, the position information of the puck obtained at present is accessed as the hit point, the time difference between the present indicator sending the indication signal and the determination of the hit is calculated (the time difference is the interval time between two hits), the time difference and the information of the hit point are sent to the terminal device for storage, the number of hit times is accumulated in the terminal device, the score this time is calculated according to a pre-set score rule, according to the mode of the indicator sending the indication signal, an instruction is sent to turn off the indicators and the sensors corresponding to the current scoring area and/or the missing area, at the same time the indicators and the sensors corresponding to the next scoring area and/or the missing area are turned on, and the time difference between the indicator sending the indication signal and the determination of the hit is calculated again. The operation of calculating and sending the instruction can be directly executed by the terminal device, and the operation of calculating and sending the instruction can also be directly executed by the processor on the modular puck dribbling plate. When the operation of calculating and sending the instruction is executed on the terminal device, the operation burden of the processor on the modular puck dribbling plate can be reduced;

S6, the operations of S3 to S5 are repeatedly performed until the training in the present inning is completed, and correspondence storage is performed on data generated by training in the present inning in the terminal device, wherein the accumulated duration of the present inning can be accumulated from the start of the execution of S2 until the training in the present inning is completed;

S7, the terminal device performs clustering analysis on the data generated by training in the present inning through a neural network algorithm, and uses an iterative algorithm to optimize an objective function to obtain classification of the data set.

In some embodiments, the process of calculating the score is as follows: judging according to the corresponding range of each score in the pre-divided scoring area, and obtaining the score corresponding to the current hit point.

A time-limited operation can also be added during the operation process of the ice hockey training system, such as:

one mode of the time-limited operation is that a threshold range corresponding to a time difference between the indicator sending the indication signal and the determination of the hit is preset in the terminal device, the hit is determined to be a valid hit if the time difference between the indicator sending the indication signal and the determination of the hit is within the threshold range, then the score is calculated, otherwise the hit is determined to be an invalid hit with a score of 0, at the same time, the number of valid hits and the number of invalid hits are accumulated in the terminal device. The difficulty of training is enhanced through the time-limited operation and the training of players' reaction agility is improved; and/or another mode of the time-limited operation is that a single training duration is preset, the single training duration being a duration during which the indicator sends an indication signal and/or a duration during which the sensor is turned on, the step S5 is entered if the hit is determined before the end of the single training duration, and the number of training times in the present inning is accumulated; at the end of a single training duration, the number of training times in the present inning is directly accumulated if the hit is missed, and at the same time, an instruction is sent to turn off the indicators and sensors corresponding to the current scoring area and/or missing area, and at the same time, the indicators and sensors corresponding to the next scoring area and/or missing area are turned on, and the time difference between the indicator sending the indication signal and the determination of the hit is recalculated again.

In some embodiments, the specific implementation process of S7 includes the following steps:

S7.1, a player age coefficient V0 is calculated according to a preset relation formula, such as: an upper limit value N0 of age is set, the player's age is N1, when N1 exceeds the upper limit value N0, $V_0=1$, and when N1 is less than the upper limit value $$N0,\ V_0 = N_1/N_0,$$

wherein the relation formula by which the player age coefficient V0 is calculated is adjustable according to the specific training impact;

S7.2, the hit rate V1 of training in the present inning is calculated according to a preset relation formula, wherein the higher the hit rate, the higher the coefficient, such as: the number of valid hits is C1, the number of invalid hits is C2, and the number of times of touching the obstacle is $$C3,\ V_1 = C_1/(C_1 + C_2 + C_3),$$

wherein the relation formula calculating the hit rate V1 of training in the present inning can be adjusted according to the specific training impact;

S7.3, a coefficient V2 of the interval time of two hits is calculated according to a preset relation formula, wherein the coefficient is higher as the interval time is shorter, such as: an upper limit value T0 of time is preset, the interval time of two hits is T1, the preset relation formula is the coefficient $$V_2 = (T_0 - T_1)/T_0,$$

and V2 has a value ranging from 0.1 to 1, wherein the relation formula calculating the coefficient V2 of the interval time between two hits can be adjusted according to the specific training impact;

S7.4, the hit point (the farther the point is from the preset hit center in the scoring area, the higher the coefficient), the cumulative training time of the present inning (the longer the training time, the higher the coefficient), and the score of the last inning are acquired and the average value of the highest 10 scores in training of the present inning (the higher the average value, the higher the coefficient), the score changes of the highest 10 times (judging whether it is a rising curve, a falling curve, a stationary line or an irregular line), and the average value of the scores of the last 5 times (the higher the average value, the higher the coefficient) are calculated, when the training of the present inning is less than 10 groups, the average score of all groups can be directly calculated as the average value of the highest 10 scores; when the number of scores in the training of the present inning is less than 10, all the current score changes can be obtained as the score changes of the highest 10 times; when the number of scores in the training of the present inning is less than 5, the average value of all current scores can be obtained as the average value of the last 5 times;

S7.5, the average number of times that the player touches the obstacle in the first 10 innings and the number of times that the player touches the obstacle in the last inning are obtained and calculated. The more obstacles are touched, the lower the coefficient is, if the number of innings trained in the historical training data corresponding to the player is less than 10 and there is training in the last inning, the average number of times of touching the obstacle in the existing training of all innings and the number of times of touching the obstacle in the last inning can be obtained as the average number of times of touching the obstacle in the first 10 innings corresponding to the player and the number of times of touching the obstacle in the last inning;

if there is no training in the last inning in the historical data corresponding to the player, the number of times of touching the obstacle in the current training can be obtained as the average number of times of touching the obstacle in the first 10 innings corresponding to the player and the number of times of touching the obstacle in training in the last inning;

S7.6, the data acquired in S7.1-S7.5 are normalized, wherein the data acquired in S7.1 can be used directly;

the data obtained in S7.2-S7.4 are used as a training positive correlation factor, and a larger coefficient is considered to indicate a higher win probability, two is set into a group and a normalization process is performed:

$$p = \frac{\text{data}_1}{\text{data}_1 + \text{data}_2},\ \text{data}_1 \neq 0 \text{ or } \text{data}_2 \neq 0,\ p = 0.5,\ \text{data}_1 = \text{data}_2 = 0,$$

wherein $\text{data}_1$ is the acquired data in S7.2-S7.4, $\text{data}_2$ is the preset data corresponding to the acquired data in S7.2-S7.4, and $\text{data}_1$ corresponds to $\text{data}_2$ one by one, p has a value range of 0-1, which is convenient for the neural network to input;

S7.5, the data obtained are used as a training negative correlation factor, and it is considered that a smaller value indicates a higher win probability, and the data are normalized:

$$t = \frac{\text{data}_3}{\text{data}_3 + \text{data}_4},\ \text{data}_3 \neq 0 \text{ or } \text{data}_4 \neq 0,\ t = 0.5,\ \text{data}_3 = \text{data}_4 = 0,$$

wherein $\text{data}_3$ is the data acquired in S7.5, $\text{data}_4$ is the preset data corresponding to the data acquired in S7.5, and $\text{data}_3$ corresponds to $\text{data}_4$ one by one, t has a value range of 0-1;

S7.7, the neural network uses supervised learning to divide the grades into three grades according to the values output by the neural network:

when the score is "0.9-1", including "0.9" and "1", the grade is advanced;

when the score is "0.5-0.9", including "0.5" and excluding "0.9", the grade is "intermediate";

when the score is lower than "0.5", excluding "0.5", the grade is "primary";

players, coaches and other personnel can adjust the training difficulty of players according to the value output by neural network.

The number and combination mode of the modular puck dribbling plate can be interconnected according to the demand through the existing mode such as buckles, so that the trainer can adjust according to his own situation, training demand, etc., so as to meet the needs of different training venues, different training difficulties and training objectives. The primary user can directly use a square single puck dribbling plate for training, and when the training difficulty is increased in the later stage, the combination of other single puck dribbling plates and the existing single puck dribbling plate will effectively reduce the training cost of players.

The mode, the upper limit value and the relation formula of the indication signal sent by the inserted indicator can be adjusted and upgraded according to the training requirements through the prior art.

The above-mentioned undisclosed matters can be directly realized by the prior art, so they will not be repeated here.

The puck dribbling single plate and the modular puck dribbling plate described by the disclosure can also be used for the training of sports items requiring dribbling/passing, such as football, curling and the like.

The foregoing is only preferred embodiments of the disclosure, and it should be noted that a number of similar modifications and modifications may be made by those of ordinary skill in the art without departing from the inventive idea of the disclosure, which are also considered to be within the scope of the disclosure.

What is claimed is:

1. A modular puck dribbling plate, comprising one or more single puck dribbling plates, wherein each single puck dribbling plate is provided with a scoring area and/or a missing area, the scoring area and the missing area are both provided with an indicator and a sensor, a processor is arranged in the single puck dribbling plate, and the indicators and the sensors are both connected with the processor, the modular puck dribbling plate is connected with a terminal device to form an ice hockey training system;

the operation process of the ice hockey training system comprises the following steps:

S1, controlling the indicator on one or more single puck dribbling plates in the modular puck dribbling plate to send an indication signal, and at the same time triggering the corresponding sensor to start working;

S2, performing an operation of dribbling the puck according to the indication signal;

S3, sensing the position information of the puck by the sensor, and transmitting the position information to the terminal device to determine whether the puck hits or touches an obstacle, and entering S5 if the puck hits, otherwise entering S4;

S4, accumulating the number of times of touching the obstacle, and transmitting the accumulated number of times of touching the obstacle to the terminal device for storage, and continuing to dribble the puck by a player to re-perform the operation of S3;

S5, calculating the time difference between the corresponding indicator sending the indication signal and the sensor sensing the puck hit and the current score, and saving the data;

S6, repeating operations of S1 to S5 until training is completed, acquiring all data stored in this training to form a data set; and S7, performing cluster analysis by a neural network algorithm, acquiring classification of the data set by optimizing an objective function via an iterative algorithm.

2. The modular puck dribbling plate according to claim 1, wherein, the single puck dribbling plate is connected with a built-in or external power supply, the processor comprises a master control module, a communication module, an indicator control module, a sensor control module, and a storage module, the communication module, the indicator control module, the sensor control module, and the storage module are all connected with the master control module, the master control module is configured to coordinate the work of each module connected thereto;

the communication module is configured to connect other single puck dribbling plates and/or a terminal device;

the indicator control module is configured to control the work of an indicator;

the sensor control module is configured to control the work of a sensor; and the storage module is configured to store preset information, and the preset information comprises identification information, and specification information of the single puck dribbling plate.

3. The modular puck dribbling plate according to claim 2, wherein the processor further comprises an identification module and a positioning module, the identification module is configured to identify identification information of other single puck dribbling plates connected with the single puck dribbling plate, the positioning module is configured to acquire a position where a single puck dribbling plate is located;

a cross-section of the single puck dribbling plate is rectangular or triangular; and the indicator is a light which is able to be combined into a variety of colors through RGB.

4. The modular puck dribbling plate according to claim 1, wherein a main body of the single puck dribbling plate is made of PE or HDPE material;

the single puck dribbling plate is a first single puck dribbling plate (1) having a rectangular cross-section or a second single puck dribbling plate (2) having a triangular cross-section, the first single puck dribbling plate (1) being adapted to the second single puck dribbling plate (2); the first single puck dribbling plate (1) is provided with one or more circular first scoring areas (101), and the first single puck dribbling plate (1) is further provided with one or more elongated first missing areas (102); the second single puck dribbling plate (2) is provided with an elongated second missing area (201).

5. The modular puck dribbling plate according to claim 1, wherein the combination mode of the single puck dribbling plates of the modular puck dribbling plate comprises:

a first combination mode, a single puck dribbling plate having a rectangular cross-section, a second combination mode, a plurality of single puck dribbling plates having rectangular cross-sections, a third combination mode, a single puck dribbling plate having a rectangular cross-section and one or more single puck dribbling plates having triangular cross-sections, and a fourth combination mode, a plurality of single puck dribbling plates having rectangular cross-sections and one or more single puck dribbling plates having triangular cross-sections; and the adjacent single puck dribbling plates are able to be disassembled.

6. The modular puck dribbling plate according to claim 5, wherein, and the connection mode of the terminal device and the modular puck dribbling plate comprises:

a first mode in which the terminal device is in communication connection with one single puck dribbling plate of the modular puck dribbling plate, the single puck dribbling plate being a main plate, and other single puck dribbling plates of the modular puck dribbling plate are in communication connection with the main plate; and a second mode in which the terminal device is directly in communication connection with all the single puck dribbling plates of the modular puck dribbling plate.

7. The modular puck dribbling plate according to claim 6, wherein the terminal device is an intelligent terminal having a display screen, the intelligent terminal is able to acquire the position and specification information of each single puck dribbling plate in the modular puck dribbling plate, and build a 3D virtual model corresponding to the modular puck dribbling plate according to the position information, each module in the 3D virtual model is in one-to-one correspondence with the single puck dribbling plate in the modular puck dribbling plate and is associated with each other, and a control interface of the corresponding single puck dribbling plate is entered by clicking the module after mutual association.

8. The modular puck dribbling plate according to claim 1, wherein the age information of the player is input before executing S1;

the operation process of the ice hockey training system further comprises an aging operation, and the aging operation is performing aging judgment on the hit information in S5, presetting a threshold range corresponding to a time difference between the indicator sending the indication signal and the determination of the hit, comparing the calculated time difference with the threshold range, judging the hit to be a valid hit if the time difference is within the threshold range, then obtaining the current score, and saving the data, otherwise judging the hit to be an invalid hit with a score of 0;

or presetting a single training duration, the single training duration being a duration during which the indicator sends an indication signal and/or a duration during which the sensor is turned on, entering the step S5 if the hit is determined before the end of the single training duration, and accumulating the number of training times in the present inning; at the end of a single training duration, directly accumulating the number of training times in the present inning if the hit is missed, and at the same time sending an instruction to turn off the indicator and sensors corresponding to the current scoring area s missing area, and at the same time turning on the indicators and sensors corresponding to the next scoring area and/or missing area, and starting to recalculate the time difference between the indicator sending the indication signal and the determination of the hit; and the number of valid hits and the number of invalid hits are accumulated separately.

* * * * *